United States Patent [19]

Douglas

[11] 4,164,173

[45] Aug. 14, 1979

[54] AIR SUPPLY SYSTEMS FOR OPERATING THEATRES

[76] Inventor: Andrew S. M. Douglas, "The Hollies", Hollin La., Styal, Cheshire, England

[21] Appl. No.: 893,249

[22] Filed: Apr. 5, 1978

Related U.S. Application Data

[63] Continuation of Ser. No. 772,957, Feb. 28, 1977, abandoned.

[51] Int. Cl.[2] ..... F24F 9/00

[52] U.S. Cl. ..... 98/36; 98/40 D; 128/1 R

[58] Field of Search ..... 98/40 D, 33 R, 36, 40 DL; 128/1 R

[56] References Cited

U.S. PATENT DOCUMENTS

| | | | |
|---|---|---|---|
| 3,511,162 | 5/1970 | Truhan | 98/36 |
| 3,602,212 | 8/1971 | Howorth | 98/40 D |
| 3,626,837 | 12/1971 | Pelosi, Jr. | 98/40 D |
| 3,998,142 | 12/1976 | Foreman et al. | 98/36 |
| 4,009,647 | 3/1977 | Howorth | 98/40 D |

*Primary Examiner*—William E. Wayner

*Attorney, Agent, or Firm*—Young & Thompson

[57] ABSTRACT

An air supply system for an operating theatre which includes a primary chamber to which filtered air is fed under pressure. A first membrane extends across the lower surface of the primary chamber and is arranged so that a high velocity downward airflow is obtained centrally of the primary chamber. The primary chamber is surrounded by a secondary chamber with a second membrane providing a permeable barrier between the two chambers and the arrangement is such that a further downward airflow is obtained from the secondary chamber, this further downward airflow surrounding the airflow issuing from the primary chamber.

5 Claims, 2 Drawing Figures

-FIG.1-
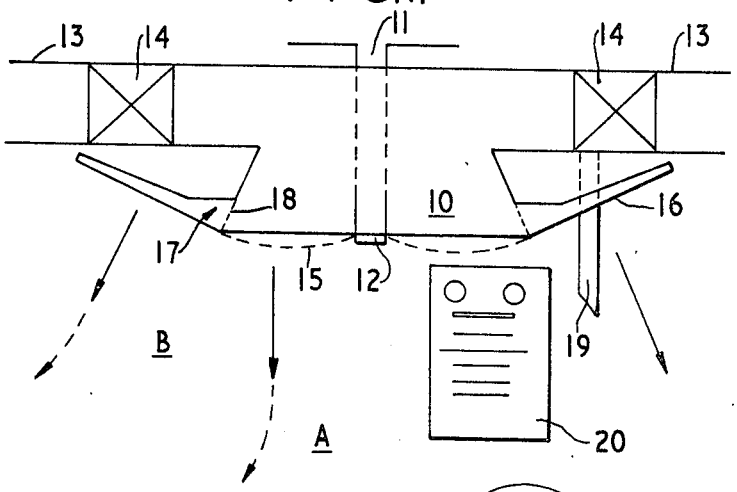
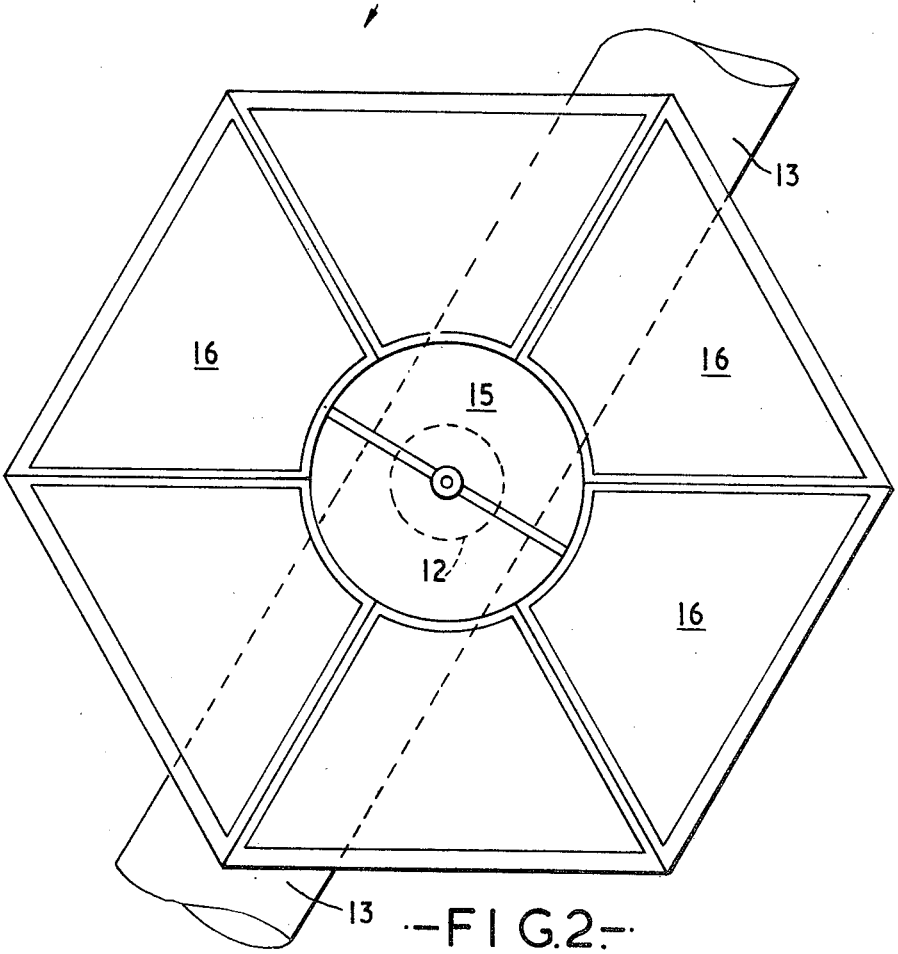
-FIG.2-

AIR SUPPLY SYSTEMS FOR OPERATING THEATRES

This is a continuation, of application Ser. No. 772,957, filed Feb. 28, 1977, now abandoned.

This invention relates to air supply systems for operating theatres.

In a conventional operating theatre equipped with an air-conditioning system, air is supplied at a controlled temperature and relative humidity through filters and is introduced into the operating theatre by diffusers located either in the walls or in the ceiling of the theatre. Tests have shown that the clean incoming air can be contaminated by entrained ambient air with the result that the organisms present on the floor of the operating theatre, as well as those emitted by the bodies of the surgical team and the patient, are circulated around the operating area with a consequent risk of infection.

A number of air supply systems have accordingly been developed which provide a downward flow of air at a speed of the order of 0.5 m./sec. to oppose convection currents. These supply systems have, however, had a variety of limitations such as those involved in providing enclosures within which downward airflow patterns have been established. It is, therefore, an object of the invention to provide an improved air supply system for operating theatres which is such as to avoid the disadvantages of the systems at present in use.

According to the invention, I provide an air supply system for an operating theatre which includes a primary chamber to which filtered air is supplied under pressure, a first membrane extending across the lower surface of the primary chamber and through which, in use, a relatively high velocity downward airflow is obtained, a secondary chamber surrounding the primary chamber with a second membrane separating the primary chamber from the secondary chamber, and said secondary chamber having a downwardly facing surface through which, in use, a further downward airflow is obtained which surrounds the airflow issuing from the primary chamber.

The first membrane extending across the lower surface of the primary chamber is preferably a textile fabric the pores of which open when high pressure conditions obtain within the primary chamber and close when the pressure within the primary chamber is at or below atmospheric pressure. The first membrane thus acts as a one-way valve so that, in the event of stoppage of the supply of high pressure air, reverse air flow is prevented since this would otherwise lead to contamination of the clean side of the filters. The second membrane separating the primary chamber from the secondary chamber may be formed of a similar fabric though the porosity thereof will preferably be greater than the porosity of the first membrane with the relative values of the porosities so chosen that the velocity of the further airflow issuing from the secondary chamber is at least as great as the velocity of the airflow issuing from the primary chamber.

In use, the high velocity downward airflow issuing from the primary chamber is caused to deluge the area around the incision formed in the patient and the entraining airflow emitted from the secondary chamber, which preferably has a radially outward component, serves as a shield to counter convection currents and reduce the risk of bacterial infection.

The invention will now be described by way of example with reference to the accompanying drawings in which:

FIG. 1 is a vertical sectional view of the air supply system for an operating theatre, and FIG. 2 is an underneath plan of the air supply system.

Air is supplied to a central pressure chamber 10 which is suspended from the ceiling of the operating theatre by means of a hollow main support pillar 11 which also serves as a housing and support for the main surgical light 12 disposed above the patient. The central chamber 10 is connected to either two or four radial air intake ducts 13 which include fan and filter modules 14 which serve to remove all solid particles above 1 micron from the air and to supply air under pressure to the pressure chamber 10.

The lower surface of the pressure chamber 10 is bounded by a membrane 15 of porous textile fabric which is formed as two semi-circular parts carried by D-shaped frame members detachably secured to diffuser elements 16 at the lower edge of the wall of the pressure chamber 10. The diffuser elements 16 define the lower surface of a secondary chamber 17 which surrounds the primary or pressure chamber 10 and is separated therefrom by a second membrane 18. The two membranes 15 and 18 serve as one-way valves in that the pores thereof open to allow flow of air when the pressure in the primary chamber 10 is greater than atmospheric pressure but close when the pressure falls to or below atmospheric pressure.

The relative porosities of the two fabrics are so chosen that the restriction to flow afforded by membrane 15 is greater than that afforded by membrane 18 to such an extent that the velocity of the air issuing through the diffuser elements 16 is at least equal to the velocity of the air issuing through the membrane 15. During downward airflow, the velocity thereof will gradually fall and the entraining airflow through the diffuser elements is given a radially outward component. This means that the velocity at a point A adjacent the centre of the downward airflow will be substantially equal to the velocity at a point B within the entraining airflow but at a higher level. Of course, when the central airflow approaches ground level, it will be deflected outwardly as indicated in FIG. 1 and it has been found that the particular airflow pattern indicated in FIG. 1 is such as to avoid eddy currents. Sterile air thus flows over the vital area, namely the incision in the patient, without the restrictions previously involved with systems in which substantially uniform airflow within an enclosure has been provided and the operating theatre staff have not been free to move into and out of the enclosure.

A services pendant 19 for the supply of medical gases, suction devices and the like hangs from the ceiling and extends through one of the sections of the diffuser so as to be accessible to persons located adjacent the operating table. A technical service panel 20 can also be located at a position within the downward airflow.

As shown in FIG. 2, the diffuser elements defining the lower surface of the secondary chamber comprise six segments and the segments are separately detachable from the structure of the device to permit replacement of the first and second membranes 15 and 18, replacement being effected when the fans of the modules 14 are in operation and a downward airflow is provided so that the entry of dirt and bacteria into the central pressure chamber 10 is prevented.

What I claim is:

1. An air supply system for an operating theatre which includes a primary chamber to which filtered air is supplied under pressure, a first membrane extending across the lower surface of the primary chamber and through which, in use, a relatively high velocity downward airflow is obtained, a secondary chamber surrounding the primary chamber with a second membrane separating the primary chamber from the secondary chamber, said secondary chamber having a downwardly facing diffuser surface surrounding the lower surface of the primary chamber and through which, in use, a further downward airflow is obtained which surrounds the airflow issuing from the primary chamber, the relative values of the porosities of the first and second membranes being so chosen that the velocity of the further airflow issuing from the secondary chamber is at least as great as the velocity of the airflow issuing from the primary chamber, and the downwardly facing diffuser surface being inclined upwardly as it extends radially outwardly from the lower surface of the primary chamber, so that said further airflow through the diffuser surface has a radially outward component.

2. An air supply system according to claim 1, wherein the first membrane extending across the lower surface of the primary chamber is a textile fabric the pores of which open when high pressure conditions obtain within the primary chamber and close when the pressure within the primary chamber is at or below atmospheric pressure.

3. An air supply system according to claim 2, wherein the second membrane separating the primary chamber from the secondary chamber is also formed of a porous textile fabric.

4. An air supply system according to claim 1, wherein the first and second membranes are detachably mounted on a fixed structure.

5. An air supply system according to claim 4, wherein a surgical light is incorporated in said fixed structure.

* * * * *